US008973687B2

(12) United States Patent
DiGiovanni

(10) Patent No.: US 8,973,687 B2
(45) Date of Patent: Mar. 10, 2015

(54) CUTTING ELEMENTS, EARTH-BORING TOOLS INCORPORATING SUCH CUTTING ELEMENTS, AND METHODS OF FORMING SUCH CUTTING ELEMENTS

(75) Inventor: Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 502 days.

(21) Appl. No.: 13/274,994

(22) Filed: Oct. 17, 2011

(65) Prior Publication Data

US 2012/0103698 A1 May 3, 2012

Related U.S. Application Data

(60) Provisional application No. 61/407,085, filed on Oct. 27, 2010.

(51) Int. Cl.
*E21B 10/46* (2006.01)
*E21B 10/573* (2006.01)

(52) U.S. Cl.
CPC ..... *E21B 10/5735* (2013.01); *B22F 2998/10* (2013.01)
USPC ..... 175/432; 428/430; 428/431; 428/434

(58) Field of Classification Search
CPC ..... E21B 10/5735; E21B 2010/565; E21B 10/567; E21B 10/46; E21B 10/56; E21B 10/573; C22C 2204/00; C22C 26/00; B22F 2005/001; B22F 2005/005; B22F 2998/10
USPC ..... 166/311, 372, 90.1, 401; 175/428, 430, 175/431, 432, 434; 51/307
See application file for complete search history.

(56) References Cited

U.S. PATENT DOCUMENTS

| | | | | |
|---|---|---|---|---|
| 5,564,511 | A | 10/1996 | Frushour et al. | |
| 5,647,449 | A | 7/1997 | Dennis | |
| 5,816,347 | A | 10/1998 | Dennis et al. | |
| 5,871,060 | A | 2/1999 | Jensen et al. | |
| 5,906,246 | A | 5/1999 | Mensa-Wilmot et al. | |
| 5,928,071 | A * | 7/1999 | Devlin | 451/547 |
| 5,957,228 | A * | 9/1999 | Yorston et al. | 175/430 |
| 6,011,232 | A | 1/2000 | Matthias | |

(Continued)

OTHER PUBLICATIONS

International Search Report for International Application No. PCT/US2011/056556 dated May 23, 2012, 4 pages.

(Continued)

*Primary Examiner* — Jennifer H Gay
*Assistant Examiner* — George Gray
(74) *Attorney, Agent, or Firm* — TraskBritt

(57) ABSTRACT

Cutting elements include a substrate, a polycrystalline table, and an asymmetric interface feature. The interface feature includes a shape that is reflectively asymmetric about at least two planes defined by x, y, and z axes of a Cartesian coordinate system defined to align a z axis of the coordinate system with the central axis of the substrate and to locate a center of the coordinate system at a midpoint along an axial height of the asymmetric interface feature. Methods of forming a cutting element involve: forming an asymmetric interface feature at an end of a substrate; distributing a plurality of superhard particles on the substrate over the asymmetric interface feature in a mold; and bonding the superhard particles in the mold to form a polycrystalline table attached to the substrate.

19 Claims, 11 Drawing Sheets

(56) References Cited

U.S. PATENT DOCUMENTS

| | | | | |
|---|---|---|---|---|
| 6,148,937 | A * | 11/2000 | Mensa-Wilmot et al. | 175/428 |
| 6,401,844 | B1 | 6/2002 | Doster et al. | |
| 6,892,836 | B1 | 5/2005 | Eyre et al. | |
| 7,223,049 | B2 | 5/2007 | Hall et al. | |
| 7,243,745 | B2 | 7/2007 | Skeem et al. | |
| 7,726,420 | B2 | 6/2010 | Shen et al. | |
| 7,757,789 | B2 * | 7/2010 | Yong et al. | 175/432 |
| 2003/0116361 | A1 | 6/2003 | Smith et al. | |

OTHER PUBLICATIONS

International Written Opinion for International Application No. PCT/US2011/056556 dated May 23, 2012, 6 pages.

* cited by examiner

CUTTING ELEMENTS, EARTH-BORING TOOLS INCORPORATING SUCH CUTTING ELEMENTS, AND METHODS OF FORMING SUCH CUTTING ELEMENTS

CROSS-REFERENCE TO RELATED APPLICATION

This application claims the benefit of the filing date of U.S. Provisional Application Ser. No. 61/407,085, filed Oct. 27, 2010, the disclosure of which is incorporated herein in its entirety by this reference.

FIELD

Embodiments of the present disclosure relate generally to cutting elements, to earth-boring tools including such cutting elements, and to methods of forming such cutting elements. Specifically, embodiments of the present disclosure relate to cutting elements including asymmetric interface features.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond compact (often referred to as "PDC") cutting elements, also termed "cutters," which are cutting elements that include a polycrystalline diamond (PCD) material, which may be characterized as a superabrasive or superhard material. Such polycrystalline diamond materials are formed by sintering and bonding together relatively small synthetic, natural, or a combination of synthetic and natural diamond grains or crystals, termed "grit," under conditions of high temperature and high pressure in the presence of a catalyst, such as, for example, cobalt, iron, nickel, or alloys and mixtures thereof, to form a layer of polycrystalline diamond material, also called a diamond table. These processes are often referred to as high temperature/high pressure ("HTHP") processes. The cutting element substrate may comprise a cermet material, i.e., a ceramic-metal composite material, such as, for example, cobalt-cemented tungsten carbide. In some instances, the polycrystalline diamond table may be formed on the cutting element, for example, during the HTHP sintering process. In such instances, cobalt or other catalyst material in the cutting element substrate may be swept into the diamond grains or crystals during sintering and serve as a catalyst material for forming a diamond table from the diamond grains or crystals. Powdered catalyst material may also be mixed with the diamond grains or crystals prior to sintering the grains or crystals together in an HTHP process. In other methods, however, the diamond table may be formed separately from the cutting element substrate and subsequently attached thereto.

As the diamond table of the cutting elements interacts with the underlying earth formation, for example, by shearing or crushing, the diamond table may delaminate or fracture because of the high stresses placed thereon. Some cutting elements may include recesses, such as, for example, grooves, depressions, indentations, and notches, formed in the cutting element substrate. The diamond table may include correspondingly mating protrusions. Other cutting elements may locate the recesses in the diamond table and the mating protrusions on the substrate. The increased contact area at the interface between the substrate and the diamond table may prevent delamination by strengthening the bond between the diamond table and the substrate. Conventionally, the recesses and correspondingly mating protrusions are symmetrical about at least one axis. An exemplary, conventional type of interface design is depicted in FIGS. 1 and 2. As shown in FIGS. 1 and 2, a cutting element substrate 10 includes a symmetric interface feature 12. The symmetric interface feature 12 is a recess or depression formed in an end of the substrate 10. The interface feature 12 comprises a plurality of radially extending grooves that terminate or truncate before reaching the peripheral edge of the substrate 10. In other words, the symmetric interface feature 12 may be said to resemble the spokes of a wheel, or an asterisk. Planes 14-14 through 24-24 (shown in the two-dimensional view of FIG. 1 as lines or axes) represent six planes intersecting a central axis 26 of the substrate 10, the intersection comprising the central axis 26, not merely a single point thereof, about which the symmetric interface feature 12 is symmetrical. In addition, the symmetric interface feature 12 shown in FIG. 1 is symmetrical about a plane (not shown) parallel with a top end surface of the substrate 10 that lies halfway down the depth of symmetric interface feature 12.

Elastic waves generated from impact and other high-stress short duration events during stable or unstable earth drilling can contribute to diamond table fracture, delamination, and even catastrophic failure of the cutting element, eventually resulting in failure of the drill bit. The elastic stress waves are usually generated at the point of contact between the cutting face of the diamond table and the underlying earth formation, but they may also be generated elsewhere within the cutting element, bit blades, drill bit, or drill string and propagate through the cutting element. Surfaces and interfaces between dissimilar materials, such as, for example, a cutting element and open air, liquid, or rock; the interface between a diamond table and a cemented tungsten carbide substrate; or the interface between a cemented tungsten carbide substrate and a braze material in pockets formed in blades of the a drag bit are just some examples where elastic stress waves can reflect, concentrate, and even cause failure. In addition to material properties, the geometry of the material or materials through which the waves propagate may contribute to stress wave amplification at these interfaces or at the surfaces defining the solid structure, such as the cutting face or periphery of the diamond table.

BRIEF SUMMARY

In some embodiments, the present disclosure includes cutting elements comprising a substrate, a polycrystalline table, and an asymmetric interface feature. The substrate has a central axis. The polycrystalline table is attached to the substrate at an interface region at an end of the polycrystalline table. The interface feature comprises a shape that is reflectively asymmetric about at least two planes defined by x, y, and z axes of a Cartesian coordinate system defined to align a z axis of the coordinate system with the central axis of the substrate and to locate a center of the coordinate system at a midpoint along an axial height of the asymmetric interface feature In further embodiments, the present disclosure includes earth-boring tools comprising a body and at least one cutting element attached to the body. The cutting element comprises a substrate having a central axis, a polycrystalline table attached to the substrate at an interface, and an interface feature located at the interface between the substrate and the polycrystalline table. The interface feature comprises a shape that is reflectively asymmetric about at least two planes defined by x, y, and z axes of a Cartesian coordinate system defined to align a z axis of the coordinate system with the central axis of the substrate and to locate a center of the coordinate system at a midpoint along an axial height of the asymmetric interface feature.

In yet further embodiments, the present disclosure includes methods of forming a cutting element comprising: forming an asymmetric interface feature at an end of a substrate, the asymmetric interface feature being reflectively asymmetric about at least two planes defined by x, y, and z axes of a Cartesian coordinate system defined to align a z axis of the coordinate system with a central axis of the substrate and to locate a center of the coordinate system at a midpoint along an axial height of the asymmetric interface feature; distributing a plurality of superhard particles on the substrate over the asymmetric interface feature in a mold; and bonding the superhard particles in the mold to form a polycrystalline table attached to the substrate.

In additional embodiments, the present disclosure includes methods of forming a cutting element, comprising: forming an asymmetric interface feature in a polycrystalline table, the asymmetric interface feature being reflectively asymmetric about at least two planes defined by x, y, and z axes of a Cartesian coordinate system defined to align a z axis of the coordinate system with a central axis of the polycrystalline table and to locate a center of the coordinate system at a midpoint along an axial height of the asymmetric interface feature; distributing a plurality of hard particles and a plurality of particles comprising a matrix material on the polycrystalline table and over the asymmetric interface feature in a mold; and sintering the plurality of hard particles and the plurality of particles comprising a matrix material in the mold to form a substrate attached to the polycrystalline table.

BRIEF DESCRIPTION OF THE SEVERAL VIEWS OF THE DRAWINGS

While the specification concludes with claims particularly pointing out and distinctly claiming what are regarded as embodiments of the present disclosure, various features and advantages of embodiments of this disclosure may be more readily ascertained from the following description of embodiments of the disclosure when read in conjunction with the accompanying drawings, in which:

DETAILED DESCRIPTION

Some of the illustrations presented herein are not meant to be actual views of any particular drill bit, cutting element, or interface feature, but are merely idealized representations that are employed to describe embodiments of the present disclosure. Thus, the drawings are not necessarily to scale and relative dimensions may have been exaggerated for the sake of clarity. Additionally, elements common between figures may retain the same or similar numerical designation.

Although some embodiments of the present disclosure are depicted as being used and employed in earth-boring drill bits, such as fixed-cutter rotary drill bits and roller cone bits, persons of ordinary skill in the art will understand that cutting elements having interface features in accordance with the present disclosure may be employed in any earth-boring tool employing a structure comprising a polycrystalline superabrasive material joined to a supporting substrate. Accordingly, the terms "earth-boring tool" and "earth-boring drill bit," as used herein, mean and include any type of bit or tool used for drilling during the formation or enlargement of a wellbore in a subterranean formation and include, for example, percussion bits, core bits, eccentric bits, bicenter bits, reamers, mills, drag bits, hybrid bits and other drilling bits and tools known in the art.

As used herein, the term "polycrystalline table" means and includes any structure comprising a plurality of grains (i.e., crystals) of material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of superabrasive material.

Figure 1:
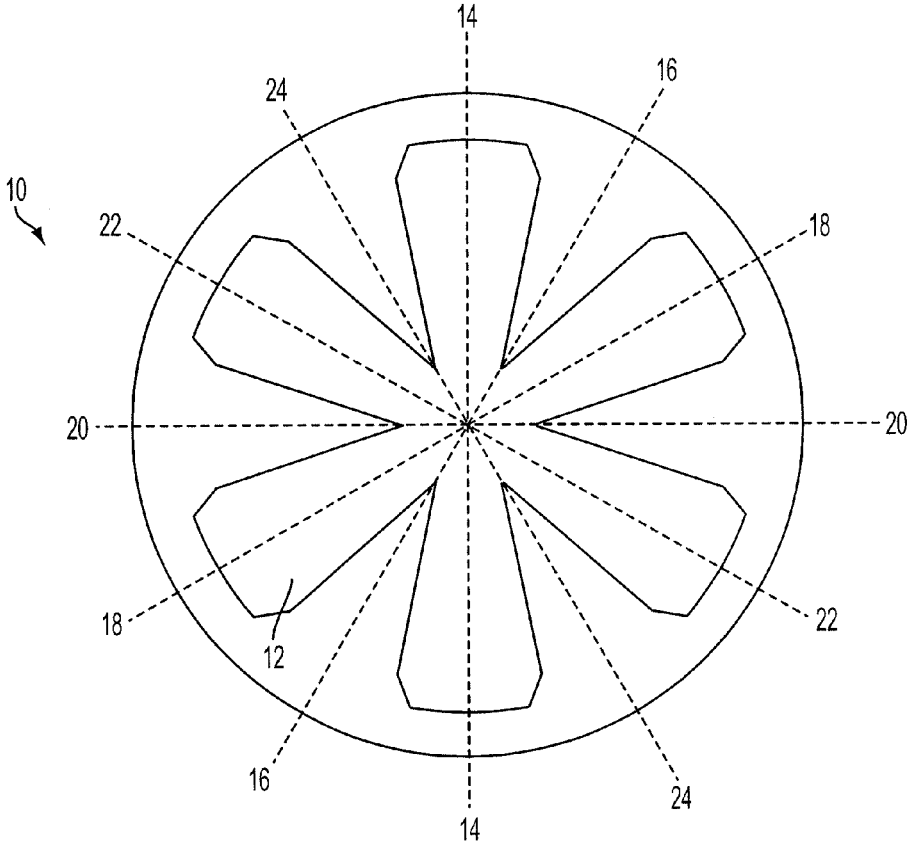
FIG. 1 (PRIOR ART)
FIG. 1 illustrates an overhead view of a prior art interface feature formed in a substrate.
Figure 2:
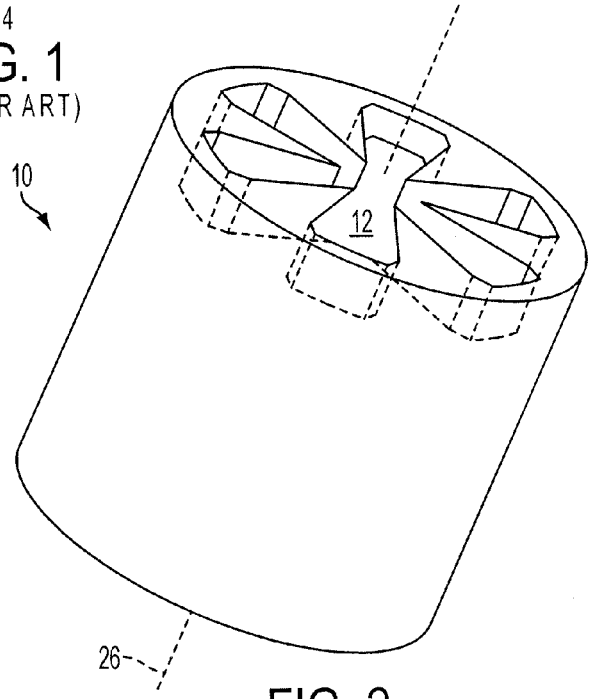
FIG. 2 (PRIOR ART)
FIG. 2 illustrates a perspective view of a prior art substrate comprising the interface feature shown in FIG. 1.
Figure 3:
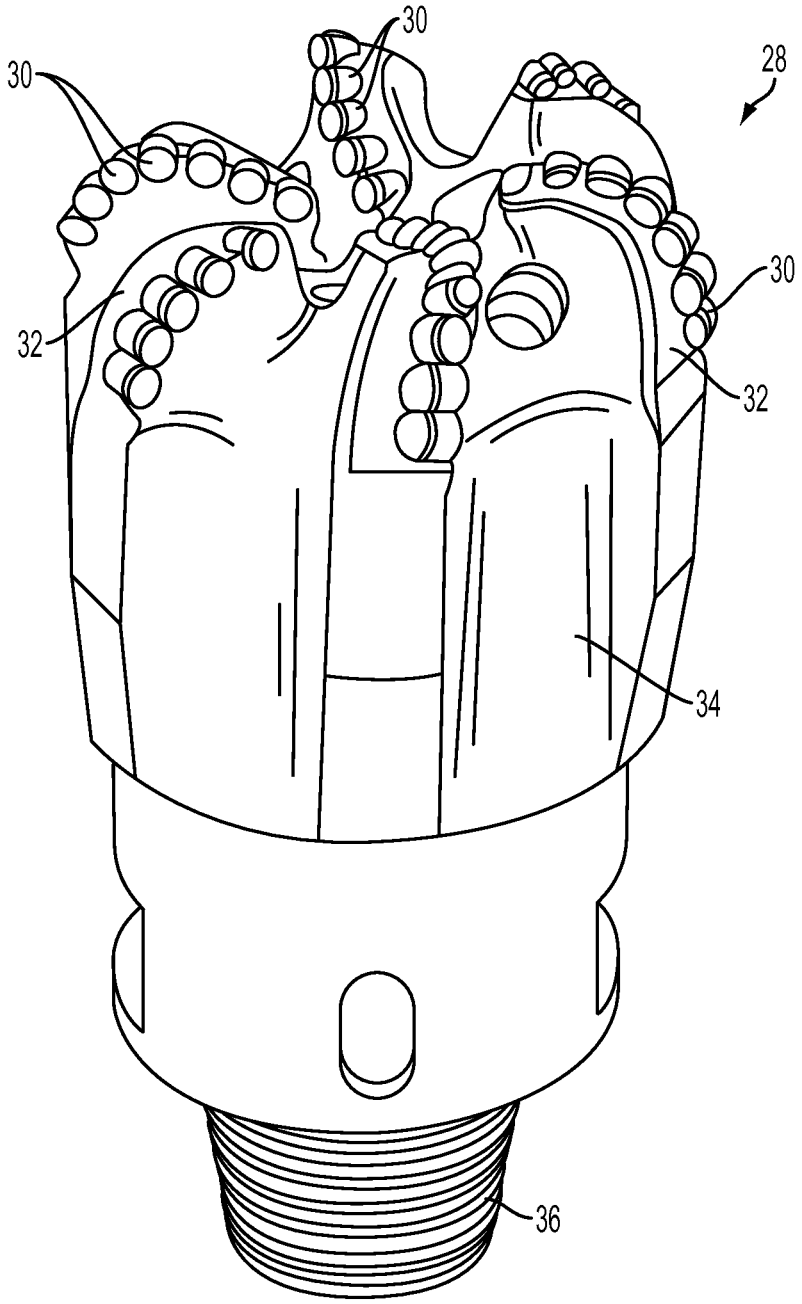
FIG. 3 illustrates a simplified perspective view of an earth-boring drill bit comprising at least one cutting element in accordance with one or more embodiments of the present disclosure.

Referring to FIG. 3, a simplified illustration of a fixed-cutter earth-boring drill bit 28 is shown. The drill bit 28 includes a plurality of cutting elements 30 including an interface feature according to one or more embodiments of the disclosure, each cutting element 30 attached to blades 32 that extend from a body 34 of the drill bit 28 for shearing material from a subterranean formation during drilling. The drill bit 28 includes a threaded section 36 at an end opposing the drilling face for connection a drill string (not shown). In operation of drill bit 28, cutting elements 30 shear formation material from the underlying earth formation being drilled.

Figure 4:
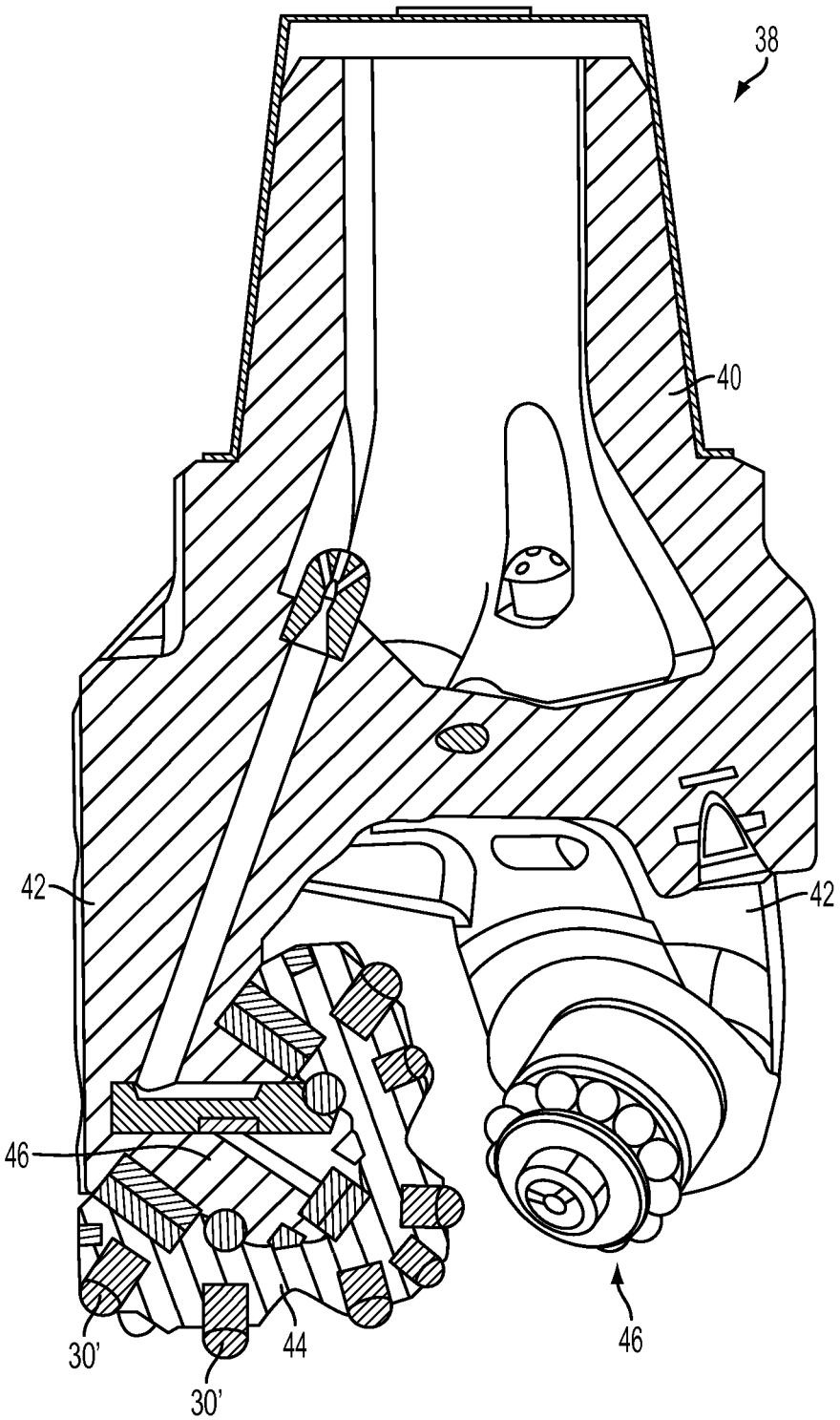
FIG. 4 illustrates a partial cutaway perspective view of another earth-boring drill bit comprising at least one cutting element in accordance with one or more embodiments of the disclosure.

FIG. 4 is a partial cutaway perspective view of a roller cone earth-boring drill bit 38. The drill bit 38 includes a bit body 40 having legs 42 depending from the body 40. A roller cone 44 is rotatably mounted to a bearing pin 46 on each of the legs 42. One of the bearing pins 46 shown in FIG. 4 is depicted without the roller cone 44. Cutting elements 30', conventionally called "inserts" when used in roller cone bits, including an interface feature in accordance with one or more embodiments of the disclosure may be attached to each roller cone 44 by insertion in recesses of a pattern of recesses in the exterior frustoconical surface of the roller cone 44. In operation of drill bit 38, the cutting elements 30' impact and crush material of the underlying earth formation being drilled.

Figure 5:
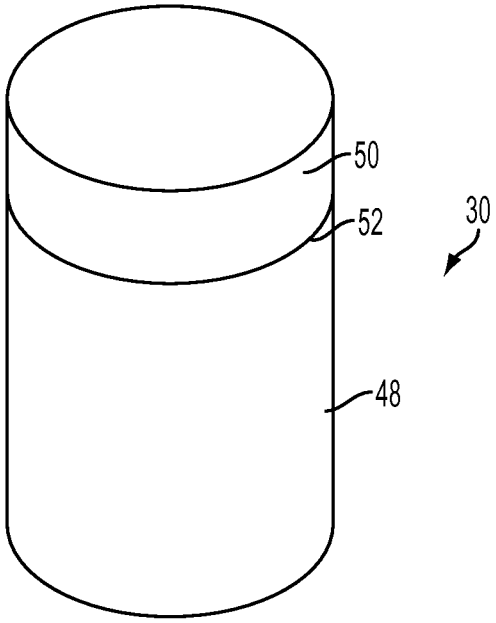
FIG. 5 illustrates a perspective view of a cutting element including an interface feature in accordance with an embodiment of the disclosure.

Referring to FIG. 5, a perspective view of a cutting element 30 including an interface feature in accordance with an embodiment of the disclosure is shown. The cutting element 30 includes a substrate 48 and a polycrystalline table 50 attached on an end of the substrate 48 along an interface 52. The polycrystalline table 50 comprises a cylindrical or disc shape.

Figure 6:
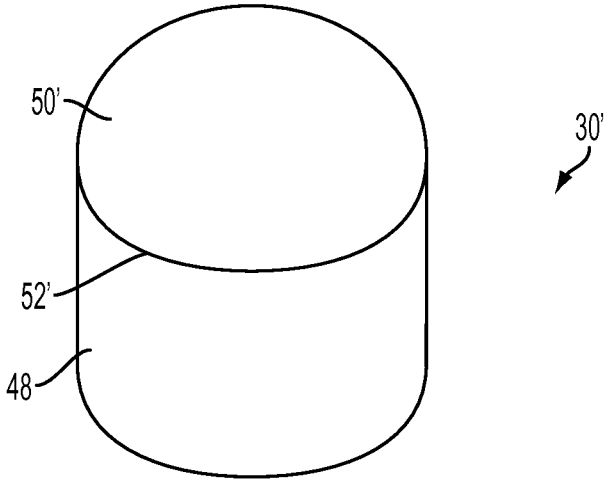
FIG. 6 illustrates a perspective view of another cutting element including an interface feature in accordance with another embodiment of the disclosure.

FIG. 6 is a perspective view of another cutting element 30' including an interface feature in accordance with an embodiment of the disclosure. The cutting element 30' includes a substrate 48 and a polycrystalline table 50' attached on an end of the substrate 48 at an interface 52'. The polycrystalline table 50' comprises a hemispherical or dome shape. In other embodiments, the cutting element 30' may comprise a tombstone shape, a chisel shape, or any other cutting element shape or configuration as known in the art.

Cutting element substrates in accordance with the present disclosure may comprise a cermet material. The cermet material may comprise a plurality of particles and a matrix material. The plurality of particles of the cermet material may comprise particles of a hard material, such as, for example, tungsten carbide. The matrix material may comprise a metal catalyst, such as, for example, cobalt, nickel, iron, or alloys or mixtures thereof.

Polycrystalline tables in accordance with the present disclosure may comprise interbonded grains of a superhard, also termed superabrasive, material. For example, grains of the polycrystalline table may comprise, synthetic diamond, natural diamond, a mixture of synthetic and natural diamond, or cubic boron nitride. The polycrystalline table may comprise a matrix material, such as, for example, a metal catalyst used to enhance grain-to-grain bonding during formation of the polycrystalline table of diamond, disposed in interstitial spaces between grains of the polycrystalline table. The use of catalysts is conventional, and such catalysts commonly include cobalt, nickel, iron and alloys and mixtures thereof. The polycrystalline table may also be leached so that interstitial spaces between grains of the polycrystalline table, or at least a portion thereof, are at least substantially free of a matrix material comprising a catalyst in order to provide thermal stability for the polycrystalline table exposed to frictional heat during a subterranean drilling operation. Other, non-metallic carbonate catalysts are known, but require more rigorous high temperature, high pressure processing in diamond table fabrication and so are not widely used. However, carbonate catalysts do not require removal from a diamond table for thermal stability.

Figure 7:
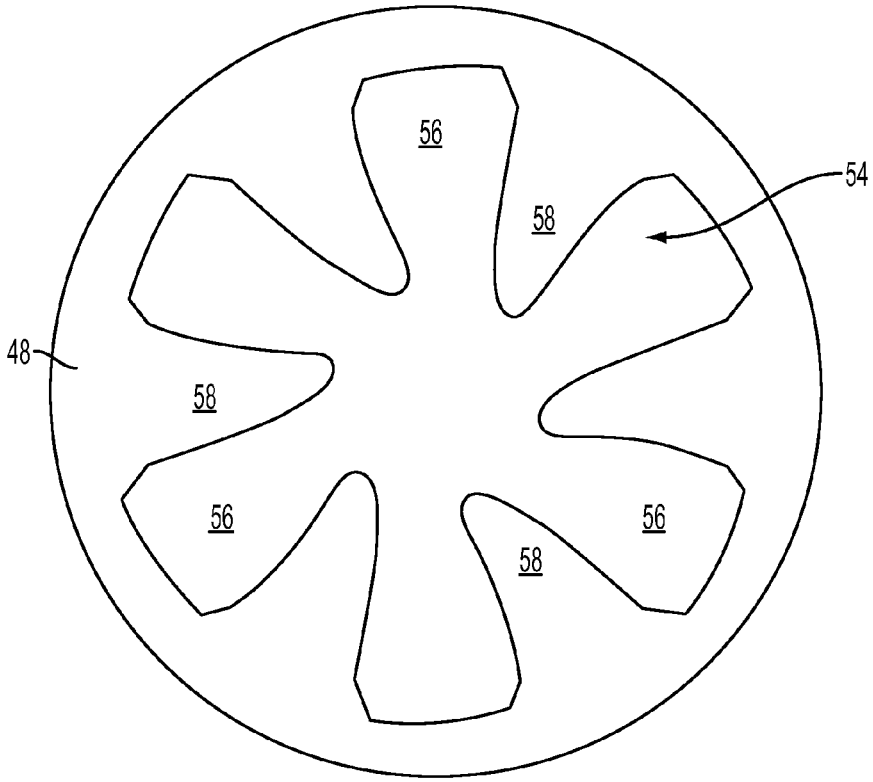
FIG. 7 illustrates an overhead view of an interface feature in accordance with an embodiment of the disclosure.
Figure 8:
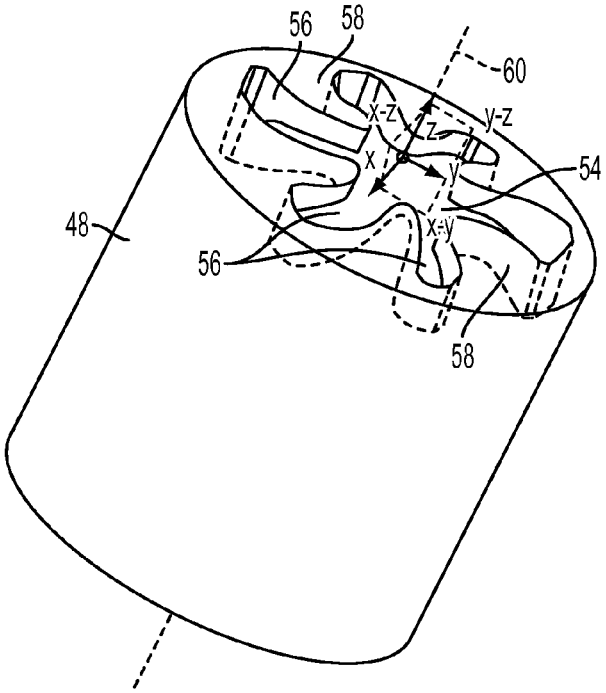
FIG. 8 illustrates a perspective view of a substrate including the interface feature shown in FIG. 7.

Referring to FIGS. 7 and 8, overhead and perspective views of an asymmetric interface feature 54 is shown. The asymmetric interface feature 54 comprises a recess or depression formed in an end of a substrate 48. The substrate 48 comprises a central axis 60. A Cartesian coordinate system having x, y, and z axes, the x, y, and z, axes being at right angles to one another, may be defined to align the z axis with the central axis 60 of the substrate 48. Orthogonal planes may be defined by the x-y, the x-z, and the y-z planes. The coordinate system may also be defined to position the center (i.e., the intersection of the x, y, and z axes) on the central axis 60 at a midpoint along the axial height of the asymmetric interface feature 54. In some embodiments, the asymmetric interface feature 54 may be rotationally asymmetric about the central axis 60. In some embodiments, the asymmetric interface feature 54 may be reflectively asymmetric (also referred to as "mirror asymmetry," "mirror-image asymmetry," and "bilateral asymmetry") about at least two of the x-y, the x-z, and the y-z planes. In other words, a first half of the asymmetric interface feature 54 may not comprise a symmetric mirror image projection of a second half of the asymmetric interface feature 54 when divided by at least two of the x-y, the x-z, and the y-z planes. In other embodiments, the asymmetric interface feature 54 may be reflectively asymmetric about each of the x-y, the x-z, and the y-z planes. In addition, the asymmetric interface feature 54 may comprise a combination of rotational and reflective asymmetry. The coordinate system may be translated or rotated within the substrate 48 to more accurately describe any combination or degree of asymmetry. Furthermore, the asymmetric interface feature 54 may be rotationally and reflectively asymmetric about all planes and axes intersecting with the substrate 48.

For example, the asymmetric interface feature 54 may comprise radially extending grooves or spokes 56 resembling the spokes of a wheel or an asterisk. Each radially extending spoke 56 is curved, regions 58 of the substrate 48 between each spoke 56 being correspondingly curved to point in a counter-clockwise direction as viewed from above. The degree to which each region 58 is curved varies from one region 58 to another region 58. In other words, the regions 58 between each spoke 56 terminate at different angles. Accordingly, the radial distance to the curved end portion of each region 58 as measured from a central axis 60 of the substrate 48 varies in a non-uniform manner.

In addition, each spoke 56 may have a different radial length as measured from the central axis 60 of the substrate 48. Accordingly, each spoke 56 may terminate at a different radial distance as measured from the perimeter of the substrate 48. Each side surface of each spoke 56 may exhibit a unique camber. In other words, surfaces of each spoke 56 that are not parallel to the top surface of the substrate 48 may be curved, each surface having a different radius of curvature. Moreover, the radially outer surfaces of each spoke 56, surfaces proximate the perimeter of the substrate 48, may be canted to a non-uniform degree.

Figure 9:
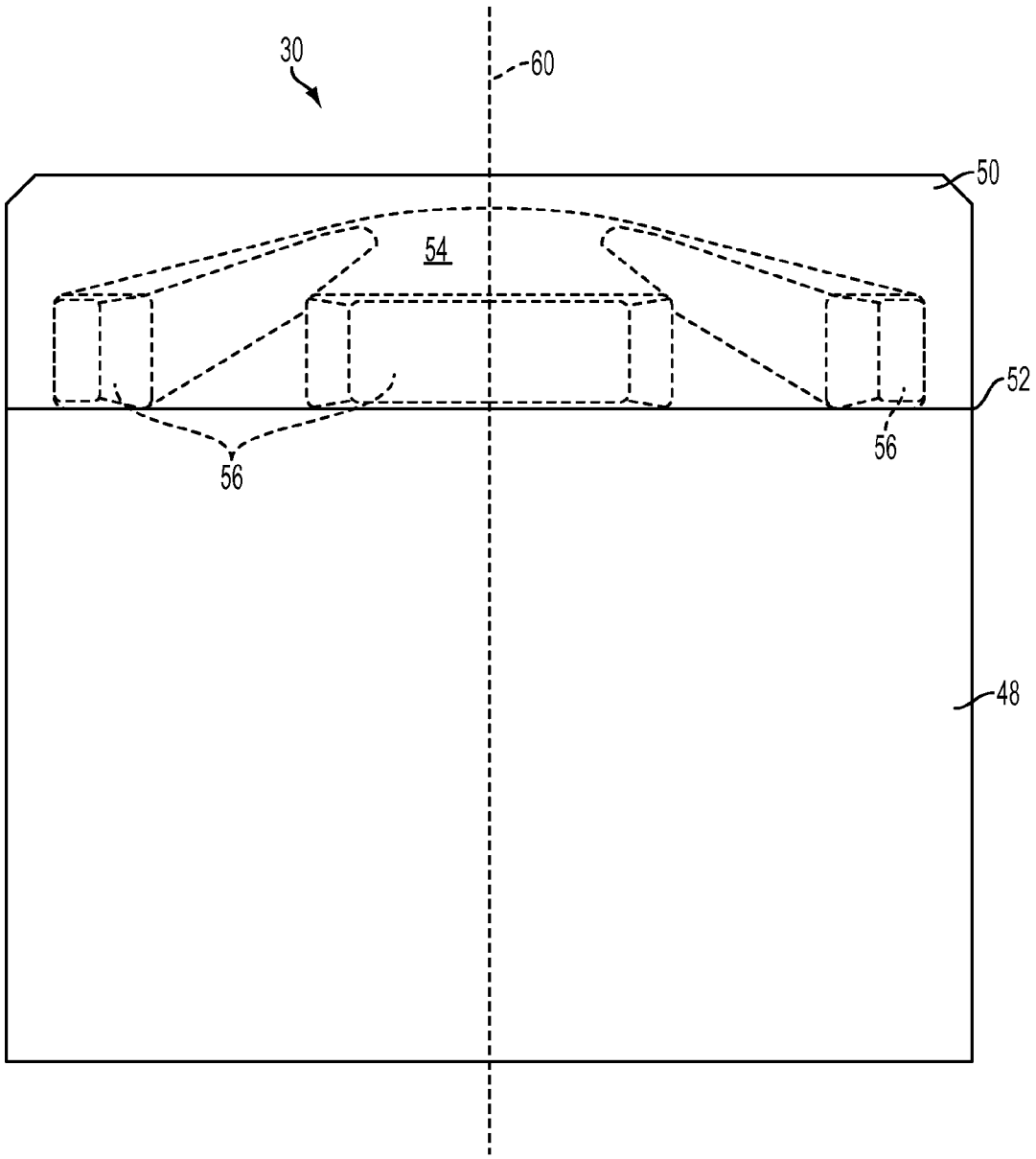
FIG. 9 illustrates a side view of a cutting element including an interface feature in accordance with an embodiment of the disclosure.

FIG. 9 is a side view of a cutting element 30 including an asymmetric interface feature 54 in accordance with an embodiment of the disclosure. The cutting element 30 includes a substrate 48 and a polycrystalline table 50 attached on an end of the substrate 48 at an interface 52. The cutting element 30 further comprises an asymmetric interface feature 54 at the interface 52 between the substrate 48 and the polycrystalline table 50. The asymmetric interface feature 54 comprises a protrusion on an end of the substrate 48 and a corresponding recess in the polycrystalline table 50. Accordingly, persons of ordinary skill in the art will understand that the asymmetric interface feature 54 may comprise a protrusion formed on a substrate and a corresponding recess formed in a polycrystalline table, a protrusion formed on a polycrystalline table and a corresponding recess formed in a substrate, or a combination of protrusions and recesses in both the polycrystalline table and the substrate.

The asymmetric interface feature 54 comprises a plurality of radially extending spokes 56. Further, the asymmetric interface feature 54 curves in an upward direction toward the polycrystalline table 50 along the central axis 60 of the cutting element 30. In other words, the asymmetric interface feature 54 comprises domed radially extending spokes 56. The radius of curvature of the domed spokes 56 may vary across the asymmetric interface feature 54. In this way, the asymmetric interface feature 54 may be asymmetric about planes and axes that intersect the cutting element 30 and are parallel to the top surface or cutting face of the polycrystalline table 50. In addition, the radius of curvature of the domed spokes 56 may vary in a different manner along each spoke 56, contributing to the overall asymmetry of the asymmetric interface feature 54.

Figure 10:
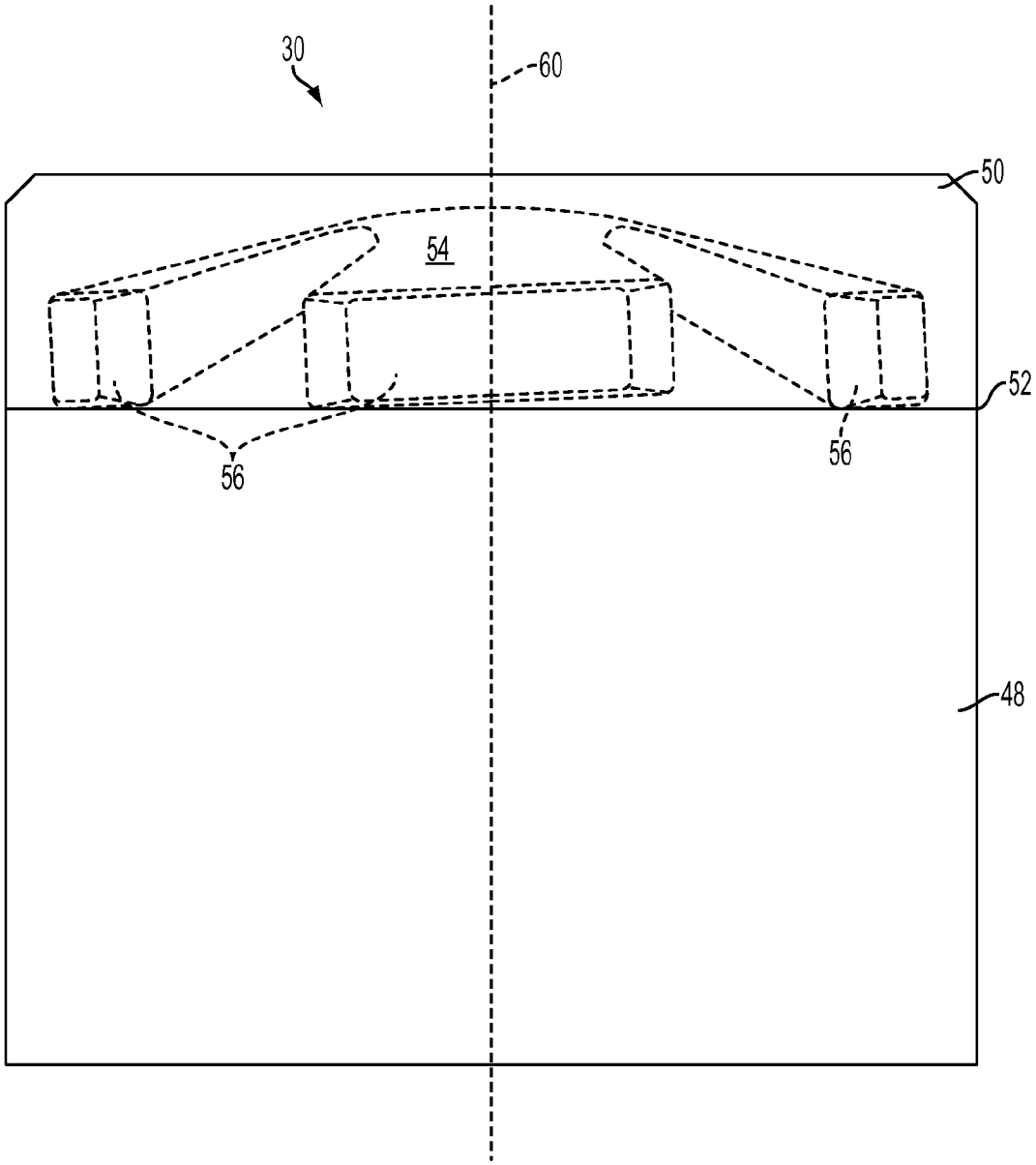
FIG. 10 illustrates a side view of a cutting element including an interface feature in accordance with an embodiment of the disclosure.

Referring to FIG. 10, a side view of a cutting element 30 including an asymmetric interface feature 54 in accordance with an embodiment of the disclosure is shown. As shown in FIG. 10, spokes 56 of the asymmetric interface feature 54 may exhibit a twist about a radially extending axis in the center of each spoke 56. Each spoke 56 may be twisted in a non-uniform manner along the radial length of the spoke 56. Each spoke 56 may exhibit a non-uniform degree of twisting. In addition, the amount of twist in each spoke 56 may vary as the radial distance from the central axis 60 of the cutting element 30 increases.

Figure 11:
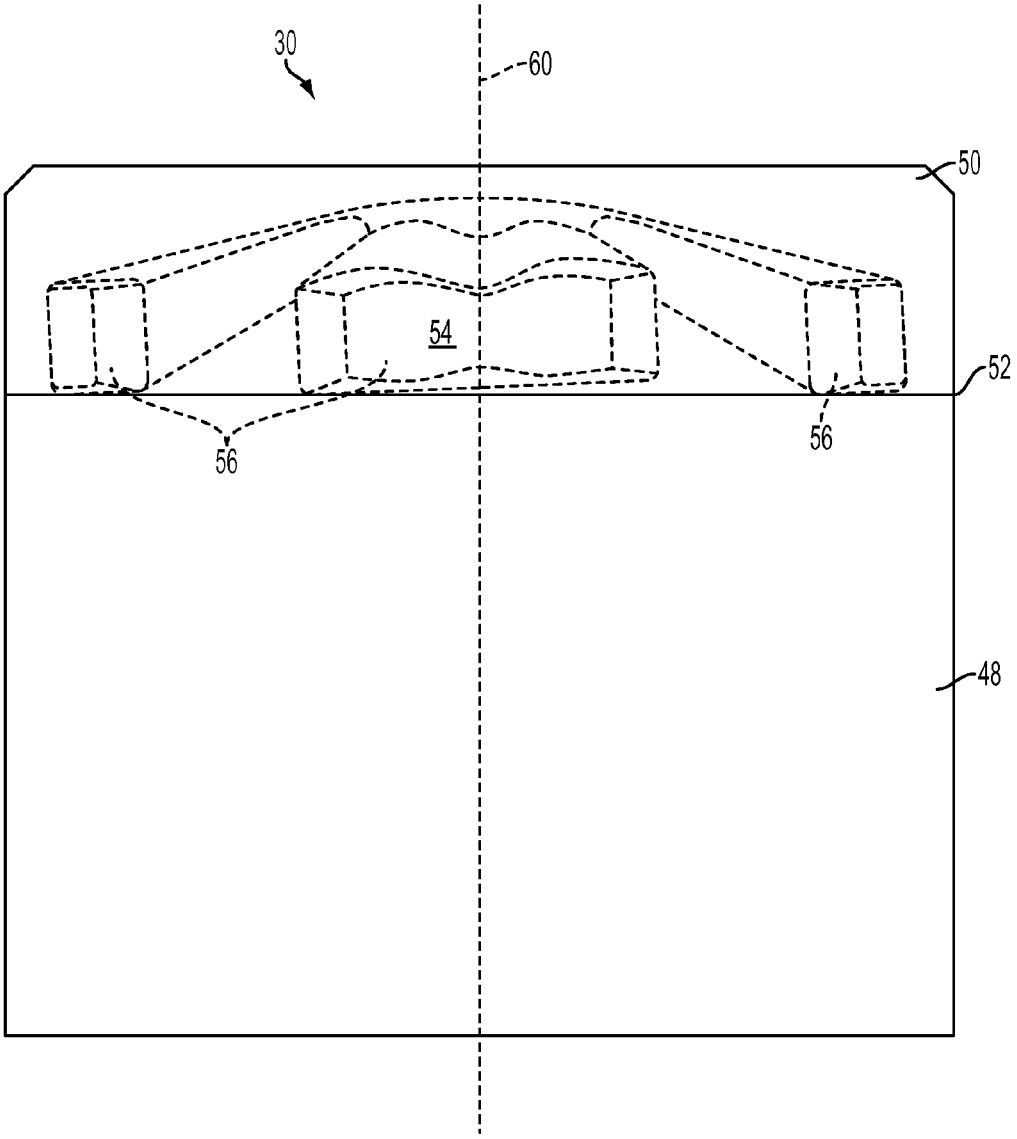
FIG. 11 illustrates a side view of a cutting element including an interface feature in accordance with an embodiment of the disclosure.

FIG. 11 illustrates a side view of a cutting element 30 including an asymmetric interface feature 54 in accordance with an embodiment of the disclosure. As shown in FIG. 11, surfaces of the spokes 56 where the polycrystalline table 50 abuts against and attaches to the substrate 48 may comprise undulations or other irregularities, asperities, or non-symmetric deformations. Though the undulations shown in FIG. 11 are shown as ridges and depressions across the width of the spoke 56, undulations may be in any direction, such as, for example, along the radial length of the spoke 56 or diagonally across the spoke 56. The undulations may be non-uniform within each spoke 56. Moreover, each spoke 56 may comprise differing undulations from each other spoke 56.

Figure 12:
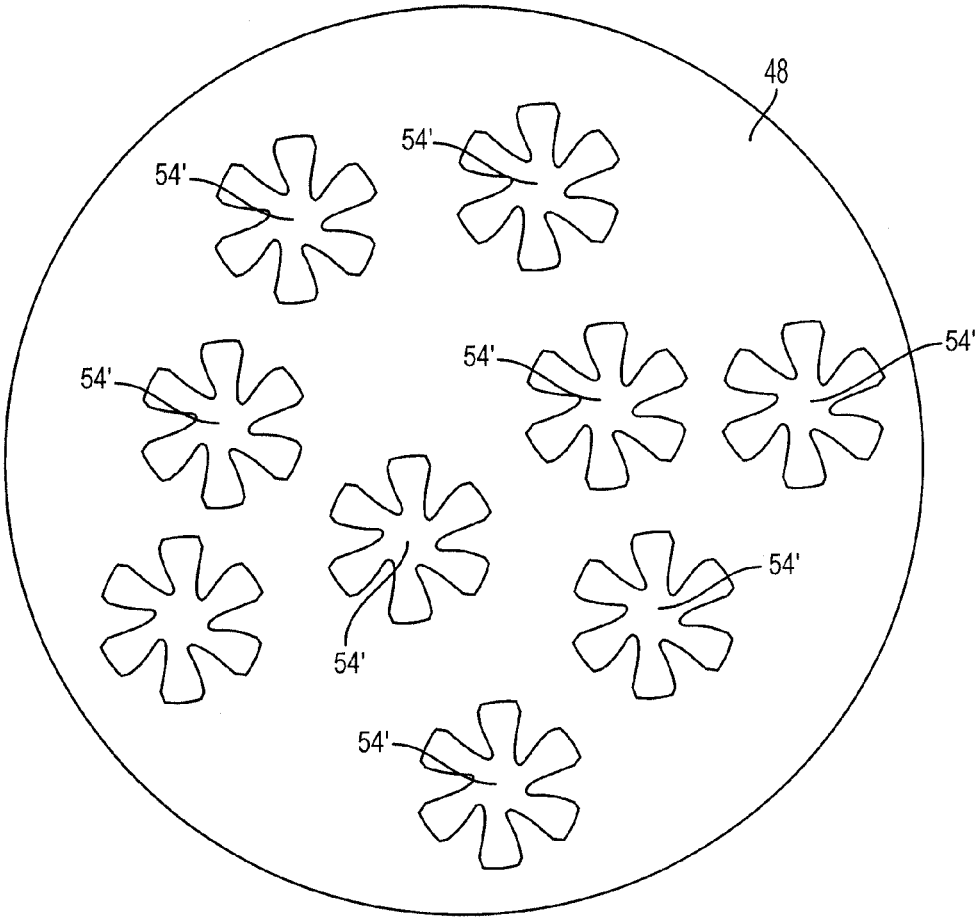
FIG. 12 illustrates an overhead view of an interface feature in accordance with an embodiment of the disclosure.

Referring to FIG. 12, an overhead view of an interface feature 54' in accordance with an embodiment of the disclosure is shown. The interface feature 54' comprises a plurality of asterisk-shaped recesses formed in a substrate 48. In other embodiments, the interface feature 54' may comprise a plurality of asterisk-shaped protrusions formed on the substrate 48. Each asterisk-shaped recess of the interface feature 54' may comprise any or all of the aforementioned features, such as, for example, radially extending spokes, curves, camber, canting, portions at varying non-uniform radial distances, domed surfaces, twisting, and undulations, used in combination to contribute to the overall asymmetry of the interface feature 54'. Moreover, the asterisk-shaped recesses may be distributed in the substrate 48 in a non-uniform asymmetric manner.

Figure 13:
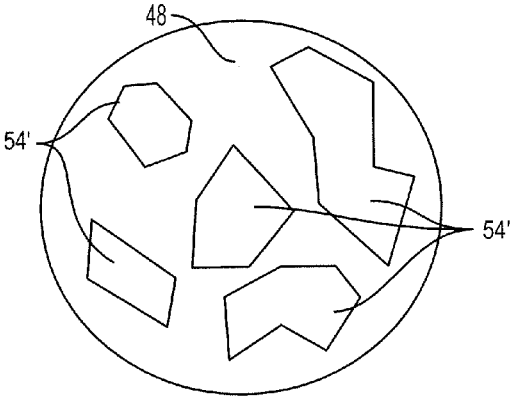
FIGS. 13 through 16 illustrate overhead views of interface features in accordance with embodiments of the disclosure.
Figure 14:
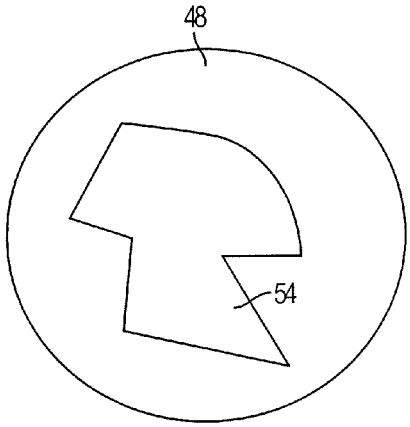
Figure 15:
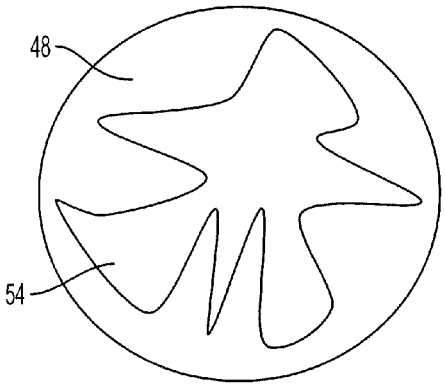
Figure 16:
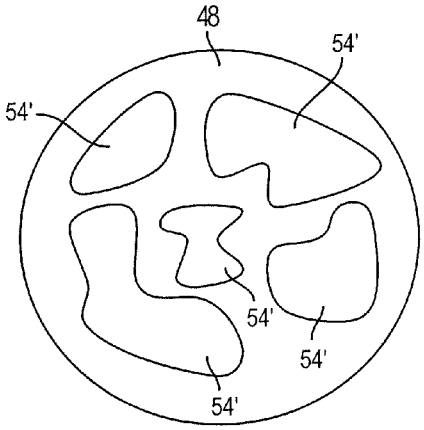

FIGS. 13 through 16 illustrate overhead views of interface features 54' in accordance with embodiments of the disclosure. Interface features 54' in accordance with embodiments of the present disclosure may comprise recesses or protrusions that are not asterisk-shaped. For example, an interface feature 54' may comprise polygons having varying numbers of side surfaces, as shown in FIG. 13. An asymmetric interface feature 54 may also comprise a combination of straight and curved side surfaces, as shown in FIG. 14. An asymmetric interface feature 54 may also comprise a shape that is not easily geometrically described, as shown in FIG. 15. An interface feature 54' may also comprise a plurality of shapes not easily geometrically described, the shapes being distributed in a non-uniform asymmetric manner, as shown in FIG. 16. Accordingly, persons of ordinary skill in the art will understand that asymmetric interface feature 54 and interface feature 54', in accordance with the present disclosure, may comprise any shape or shapes employing any of the aforementioned features to contribute to the overall asymmetry of asymmetric interface feature 54 and interface feature 54'.

In addition, persons of ordinary skill in the art will understand that the interface 52 between the substrate 48 and the polycrystalline table 50 may not comprise readily identifiable boundaries. For example, a mixture of superhard particles, hard particles, and powdered catalyst material may be provided in between the polycrystalline table 50 and the substrate 48 and sintered to form an intermediate region. The intermediate region formed by the mixture of superhard particles, hard particles, and powdered catalyst material may be uniform throughout the layer, or may be graded. Thus, the boundary between the substrate 48 and the polycrystalline table 50 may exhibit a gradient as the material composition transitions from the hard particles of the substrate 48 to the superhard particles of the polycrystalline table 50. In fact, the gradient may be selectively distributed to be asymmetric about all planes and axes intersecting with the transition region between the substrate 48 and the polycrystalline table 50.

Figure 17:
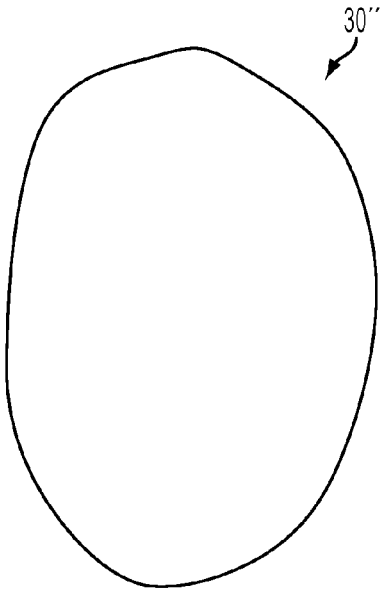
FIG. 17 illustrates an overhead view of a cutting element in accordance with an embodiment of the disclosure.
Figure 18:
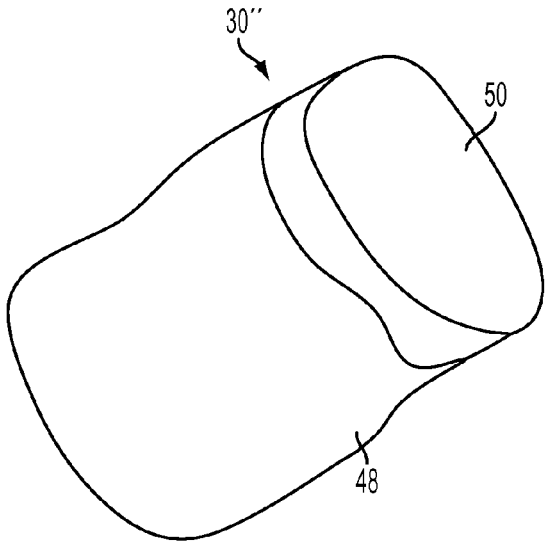
FIG. 18 illustrates a perspective view of the cutting element shown in FIG. 17.

Referring to FIGS. 17 and 18, a cutting element 30" in accordance with an embodiment of the disclosure is shown. The cutting element 30" includes a polycrystalline table 50 attached to a substrate 48. The cutting element 30" may comprise a generally oval cross-section. As best shown in FIG. 17, the generally oval cross-section of the cutting element 30" may comprise undulations or other irregularities, asperities, or non-symmetric deformations. Thus, the geometry of the cutting element 30" cross-section may be asymmetric about all planes and axes intersecting with the cutting element 30". Additionally, the lateral side surfaces of the polycrystalline table 50 and the substrate 48 may comprise undulations or other irregularities, asperities, or non-symmetric deformations, as best shown in FIG. 18. Thus, the geometry of the lateral side surface of the cutting element 30" may be asymmetric about all axes and planes intersecting with the cutting element 30".

Figure 19:
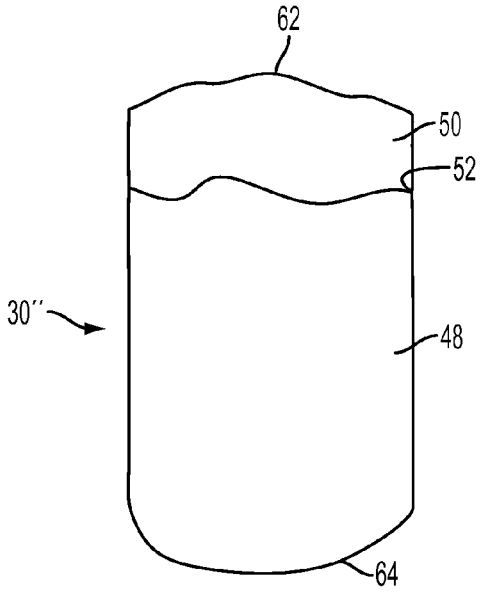
FIG. 19 illustrates a side view of a cutting element in accordance with an embodiment of the disclosure.

Referring to FIG. 19, a cutting element 30" in accordance with an embodiment of the disclosure is shown. The cutting element 30" includes a polycrystalline table 50 attached to a substrate 48. A cutting face 62, the interface 52 between the polycrystalline table 50 and the substrate 48, and a back end 64 of the cutting element 30" may comprise undulations or other irregularities, asperities, or non-symmetric deformations. Thus, the geometry of cutting face 62, the interface 52 between the polycrystalline table 50 and the substrate 48, and the back end 64 of the cutting element 30" may be asymmetric about all axes and planes intersecting with the cutting element 30".

In summary, interface features at the interface region between the polycrystalline table and the substrate of a cutting element may be asymmetric about all planes and axes that intersect with the interface features. Being asymmetric about all planes and axes that intersect with the interface features may mean that substantially all describable feature dimensions of the interface feature may differ in size, shape, and orientation from all other feature dimensions in the interface feature. Any or all of the foregoing asymmetric aspects may be used in combination with one another to contribute to the overall asymmetry of the interface feature. In addition, the cutting element geometry itself may be asymmetric. Variations in the geometry of the cutting element and the interface feature may be selected to attenuate elastic waves by taking into account the wave attenuation enabled by the material properties of the cutting element, and by taking into account the different types of elastic waves, such as, for example, primary waves ("pressure waves" or "P-waves) and secondary waves ("shear waves" or "S-waves"). A finite element analysis may aid in selecting the appropriate geometry and degree of asymmetry for a given application. Moreover, persons of ordinary skill in the art will understand that the foregoing asymmetric aspects may be used in connection with interface features that do not comprise radially extending spokes, such as, for example, annular grooves, speckled protrusions, or any geometric shape. The asymmetric geometry may prevent stress wave reflections from amplifying back on themselves and improve wave dispersion, ultimately increasing the durability of a cutter by reducing the fractures related to the stress amplifications. Stated another way, the presence and configurations of asymmetric interface features may attenuate elastic waves to reduce or eliminate fracturing, cracking, spalling, and delamination of a polycrystalline table from a supporting substrate, and ultimate failure of the cutting element. The required amount of asymmetry will vary depending on the material properties of regions of the cutting element and the stress wave amplitude and frequency or amplitudes and frequencies anticipated to be encountered during a drilling operation. Such required degree of asymmetry can be mathematically modeled using finite element analysis techniques.

Asymmetric interface features may be formed integrally with portions of the cutting element. By way of example, an asymmetric interface feature may be formed integrally while forming a substrate. A plurality of hard particles and a plurality of particles comprising a matrix material may be disposed in a mold. The mold may include features formed therein, the features being configured to impart an asymmetric interface feature to a formed substrate. In other embodiments, the mold may not include features configured to impart an asymmetric interface feature to the formed part, but the asymmetric interface feature may be formed into the part subsequently, such as, for example, by conventional machining processes. The hard particles and the particles comprising a matrix material disposed in a mold may then be pressed to form a green part, which may include the asymmetric interface features at one end thereof, or the green part may be removed from the mold and the asymmetric interface features machined from one end thereof. Pressing to form a green part may be sufficient for the green part to retain the shape imparted to it by the mold. In other embodiments, the green part may be partially sintered in the mold to form a brown part, which may also be machinable if the asymmetric interface features are not already formed. In still other embodiments, the green part may be fully sintered in the mold to a final density, the fully sintered part being a substrate comprising an asymmetric interface feature. Diamond grit, or another mixture of superhard particles, and particles comprising a catalyst material may be provided in a mold containing any of the green part, the brown part, or the fully sintered substrate, and may be subjected to an HTHP process to form a polycrystalline table. The HTHP process may also fully sinter the green or brown parts to a fully sintered substrate. A cutting element comprising a polycrystalline table, a substrate, and an asymmetrical interface feature at the interface between the polycrystalline table and the substrate may thus be formed. The polycrystalline table may be partially or completely leached of the catalyst material in subsequent processing.

In other embodiments, an asymmetric interface feature may be formed integrally while forming a polycrystalline table. Diamond grit, or another mixture of superhard particles, and particles comprising a catalyst material may be provided in a mold. The mold may include features formed therein, the features being configured to impart an asymmetric interface feature to a formed polycrystalline table. The mixture of superhard particles and particles comprising a catalyst material may then be subjected to an HTHP process to form a polycrystalline table comprising an asymmetric interface feature. The polycrystalline table may then be combined with hard particles and particles comprising a matrix material in a mold. The mold may then be pressed and heated, sintering the hard particles and particles comprising a matrix material into a substrate and attaching the preformed polycrystalline table to the substrate at an interface comprising the asymmetric interface feature. The polycrystalline table may be partially or completely leached of the catalyst material at any time after formation.

Of course, both the polycrystalline table and the substrate may each be preformed with mating, asymmetric interface features, and attached, as by brazing or by melting of a metal foil or other metal layer placed between the components or preformed on one of them and heating under application of pressure.

While the present disclosure has been described herein with respect to certain example embodiments, those of ordinary skill in the art will recognize and appreciate that it is not so limited. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventor.

What is claimed is:

1. A cutting element, comprising:

a substrate having a central axis, wherein an exposed lateral side surface of the substrate is reflectively and rotationally asymmetric with respect to all axes and planes intersecting with the substrate;

a polycrystalline table attached to the substrate at an interface region at an end of the polycrystalline table; and an interface feature, the interface feature comprising a plurality of radially extending spokes that are reflectively asymmetric about at least two planes defined by x, y, and z axes of a Cartesian coordinate system defined to align a z axis of the coordinate system with the central axis of the substrate and to locate a center of the coordinate system at a midpoint along an axial height of the interface feature, the plurality of radially extending spokes being rotationally asymmetric about at least the central axis of the substrate.

2. The cutting element of claim 1, wherein the interface feature is configured to attenuate elastic waves.

3. The cutting element of claim 1, wherein a distance from the central axis to a radially outermost portion of each spoke of the plurality of radially extending spokes is different from a distance from the central axis to a radially outermost portion of each other spoke of the plurality of radially extending spokes.

4. The cutting element of claim 1, wherein the interface feature is reflectively asymmetric about each of three planes defined by the x, y, and z axes of the coordinate system.

5. The cutting element of claim 1, wherein the interface feature is curved such that an axial position of a lowermost portion of the interface feature at the central axis is different from the axial position of a lowermost portion of the interface at a periphery of the cutting element.

6. The cutting element of claim 5, wherein a radius of curvature of each spoke of the plurality of spokes is different from a radius of curvature of each other spoke of the plurality of spokes.

7. The cutting element of claim 1, wherein each spoke of the plurality of spokes comprises undulations, the undulations of each spoke of the plurality of spokes being different from the undulations of each other spoke of the plurality of spokes.

8. The cutting element of claim 1, wherein a cross-sectional shape of the cutting element is reflectively and rotationally asymmetric with respect to all planes and axes intersecting with the cutting element.

9. The cutting element of claim 1, wherein the interface feature comprises a plurality of mating depressions and protrusions distributed asymmetrically at the interface between the substrate and the polycrystalline table, the mating depressions and protrusions comprising polygons having varying numbers of side surfaces.

10. The cutting element of claim 1, wherein a cutting face of the polycrystalline table comprises undulations.

11. An earth-boring tool, comprising:

a body; and at least one cutting element attached to the body, the cutting element comprising:

a substrate having a central axis, wherein an exposed lateral side surface of the substrate is reflectively and rotationally asymmetric with respect to all axes and planes intersecting with the substrate;

a polycrystalline table attached to the substrate at an interface; and an interface feature located at the interface between the substrate and the polycrystalline table, the interface feature comprising a plurality of radially extending spokes that are reflectively asymmetric about at least two planes defined by x, y, and z axes of a Cartesian coordinate system defined to align a z axis of the coordinate system with the central axis of the substrate and to locate a center of the coordinate system at a midpoint along an axial height of the interface feature, the plurality of radially extending spokes being rotationally asymmetric about at least the central axis of the substrate.

12. A method of forming a cutting element, comprising:

forming an asymmetric interface feature at an end of a substrate, the interface feature comprising a plurality of radially extending spokes that are reflectively asymmetric about at least two planes defined by x, y, and z axes of a Cartesian coordinate system defined to align a z axis of the coordinate system with a central axis of the substrate and to locate a center of the coordinate system at a midpoint along an axial height of the interface feature, the plurality of radially extending spokes being rotationally asymmetric about at least the central axis of the substrate, wherein an exposed lateral side surface of the substrate is reflectively and rotationally asymmetric with respect to all axes and planes intersecting with the substrate;

distributing a plurality of superhard particles on the substrate over the interface feature in a mold; and bonding the superhard particles in the mold to form a polycrystalline table attached to the substrate.

13. The method of claim 12, wherein forming the interface feature at an end of a substrate comprises curving the interface feature such that an axial position of a lowermost portion of the interface feature at the central axis is different from the axial position of a lowermost portion of the interface at a periphery of the cutting element.

14. The method of claim 13, further comprising causing a radius of curvature of each spoke of the plurality of spokes to be different from a radius of curvature of each other spoke of the plurality of spokes.

15. The method of claim 12, further comprising canting each radially extending spoke of the plurality of radially extending spokes to a different degree from each other radially extending spoke of the plurality of radially extending spokes.

16. The method of claim 12, further comprising curving each surface of the interface feature with a different camber from each other surface of the interface feature.

17. The method of claim 12, wherein forming the interface feature at the end of the substrate comprises causing each radially extending spoke of the plurality of radially extending spokes to exhibit a different degree of twist along the radial length of each spoke when compared to a degree of twist of each other radially extending spoke of the plurality of radially extending spokes.

18. The method of claim 12, further comprising shaping the interface feature such that a distance from the central axis to a radially outermost portion of each spoke of the plurality of radially extending spokes is different from a distance from the central axis to a radially outermost portion of each other spoke of the plurality of radially extending spokes.

19. A method of forming a cutting element, comprising:

forming an asymmetric interface feature in a polycrystalline table, the interface feature comprising a plurality of radially extending spokes that are reflectively asymmetric about at least two planes defined by x, y, and z axes of a Cartesian coordinate system defined to align a z axis of the coordinate system with a central axis of the polycrystalline table and to locate a center of the coordinate system at a midpoint along an axial height of the interface feature, the plurality of radially extending spokes being rotationally asymmetric about at least the central axis of the substrate;

distributing a plurality of hard particles and a plurality of particles comprising a matrix material on the polycrystalline table and over the interface feature in a mold; and sintering the plurality of hard particles and the plurality of particles comprising a matrix material in the mold to form a substrate attached to the polycrystalline table, wherein an exposed lateral side surface of the substrate is reflectively and rotationally asymmetric with respect to all axes and planes intersecting with the substrate.

* * * * *